United States Patent [19]

Ecklund

[11] 4,405,837

[45] Sep. 20, 1983

[54] TONE DETECTOR CIRCUIT

[75] Inventor: Lawrence M. Ecklund, Wheaton, Ill.

[73] Assignee: Motorola, Inc., Schaumburg, Ill.

[21] Appl. No.: 218,878

[22] Filed: Dec. 22, 1980

[51] Int. Cl.[3] ..... H04H 5/00

[52] U.S. Cl. ..... 179/1 GS; 307/522; 328/136

[58] Field of Search ..... 179/1 D, 1 G, 1 GM, 179/1 GN, 1 GS; 307/354, 360, 518, 520, 522; 340/825.71, 825.72; 328/136, 140

[56] References Cited

U.S. PATENT DOCUMENTS

| | | | |
|---|---|---|---|
| 3,558,911 | 1/1971 | Chen | 340/825.71 |
| 3,717,818 | 2/1973 | Herbst | 307/522 X |
| 3,792,290 | 2/1974 | Brocker | 328/133 X |
| 3,953,832 | 4/1976 | Streckenbach | 340/825.71 |
| 4,031,463 | 6/1977 | Norberg | 307/360 X |
| 4,066,848 | 1/1978 | Darwood | 328/136 X |
| 4,139,851 | 2/1979 | Risko | 307/360 X |
| 4,159,398 | 6/1979 | Hilbert et al. | 179/1 GS |
| 4,216,463 | 8/1980 | Backof et al. | 340/825.71 |

*Primary Examiner*—A. D. Pellinen

*Attorney, Agent, or Firm*—Margaret Marsh Parker; James W. Gillman; James S. Pristelski

[57] ABSTRACT

A low frequency tone detector filters out higher frequencies, then a latching circuit locks on when a given number of low frequency cycles are detected which have at least a predetermined peak amplitude. Thereafter, only a second given number of missing or low amplitude cycles will reset the latch. The circuit is particularly suited to use with AM stereophonic signals where a low frequency tone is added to the difference channel for providing mono/stereo indication and mode switching. The circuit can also provide an early detect for use by a scanning circuit in a receiver.

16 Claims, 4 Drawing Figures

TONE DETECTOR CIRCUIT

BACKGROUND OF THE INVENTION

This invention relates to the field of tone detectors and, more particularly, to the use of low frequency tone detectors with stereophonic signals.

Many tone detectors are known which consist mainly of low-pass or bandpass filters, active or passive, with the output rectified to obtain a DC mode-controlling signal. One such system is shown in U.S. Pat. No. 4,159,398, assigned to the assignee of the present invention. The patent discloses AM stereophonic transmission and reception of a signal including a very low frequency stereo presence tone. One problem which can arise with a simple filter/rectifier combination is that false stereo indication signals can be triggered by noise or other signals at or very near the tone frequency. The user of a stereophonic receiver having a falsing problem may see a flickering indicator lamp and hear the audio move back and forth between the "middle" or monophonic position and the separate stereo positions. Any tone detector added to a receiver which includes "scanning" should provide for an early "non-detect" in order to avoid slowing down the scan.

SUMMARY OF THE INVENTION

It is, therefore, an object of the present invention to provide a tone detector which is essentially false-free.

It is a particular object to provide a tone detector suitable for use with AM stereophonic receivers.

It is another object to provide the capability of an early "non-detect" of stereophonic signals.

These objects and others which will become apparent are obtained in a circuit for receiving signals which may include one signal of a predetermined, very low frequency. The received signals are filtered to eliminate all signals at frequencies apart from the predetermined frequency. The filter output is coupled to a latching circuit which provides one output signal when a given number of cycles having a given amplitude have been detected in sequence, and a second output signal when a given number of cycles is lacking or of insufficient amplitude.

DETAILED DESCRIPTION OF A PREFERRED EMBODIMENT

Figure 1:
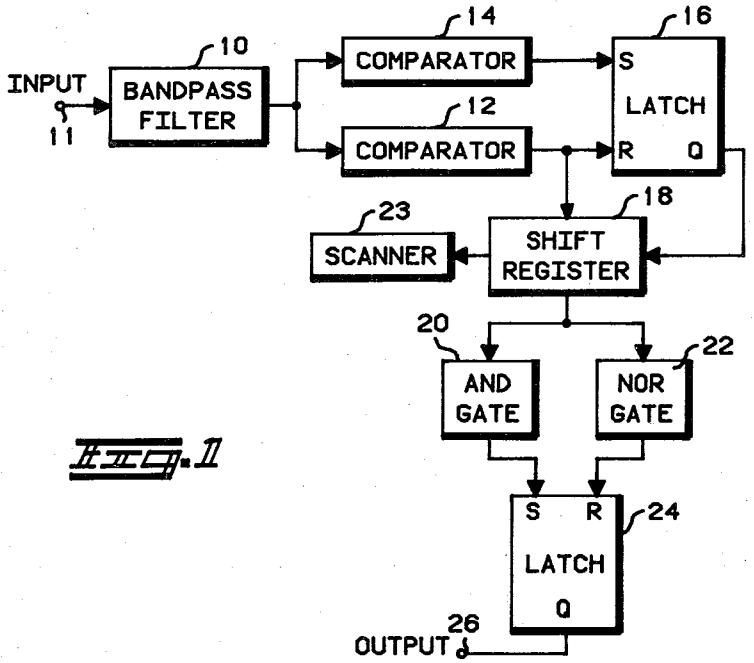
FIG. 1 is a block diagram of the detector of the invention.

In the block diagram of FIG. 1, the input to a bandpass filter 10 at an input terminal 11 will normally be comprised of a wide range of frequencies. The input terminal 11 may represent an RF stage, mixer, IF stage and demodulator, whereby the input to the filter 11 is an audio signal. In most applications, these will be audio frequencies including one particular frequency which it is desired to detect for some control purpose. One specific application will be described, namely, an AM stereophonic receiver wherein a low frequency pilot tone is included in the received stereo signal, but the invention is not to be construed as limited thereto. It is, in fact, applicable to any apparatus wherein it is necessary to not only detect a single frequency in a received signal, but to prevent false detection signals, and to detect when that single frequency fades or disappears for a specified period.

The filter 10 will preferably be a very narrow bandpass filter, although it is possible that a low-pass, high-pass or wider bandpass filter might be used in particular applications. The output of the filter 10 is coupled separately to two comparators 12, 14. The output of the comparator 12 is coupled to the "reset" input of a latch 16 and to a shift register 18. The output of the comparator 14 is coupled to the "set" of the latch 16. The latch 16 output is also coupled to the register 18 and the register outputs are coupled in parallel to two logic gates, an AND gate 20 and a NOR gate 22. At least one output of the register 18 is coupled to a scanner 23 as will be described with relation to FIG. 2. The AND gate 20 output is coupled to the "set" input of a latch 24 and the NOR gate 22 output is coupled to the "reset" input. The latch 24 output is coupled via an output terminal 26 to whatever external circuitry (see FIG. 4) will utilize the signal detection.

Figure 2:
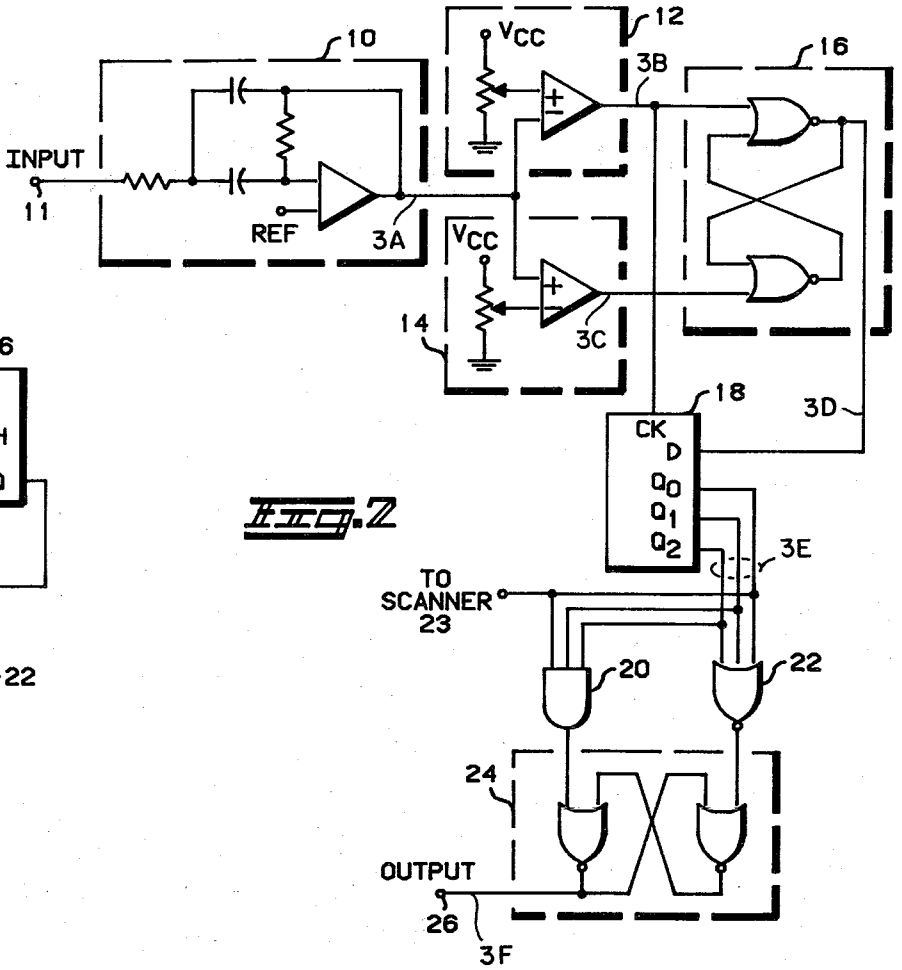
FIG. 2 is a logic diagram of the detector.

FIG. 2 shows in logic/schematic form the detector of FIG. 1 and will be explained in conjunction with the timing chart of FIG. 3. As explained above, the signals at the input 11 of the filter 10 may be comprised of many frequencies, but the filter output signal will be essentially a sine wave (3A), depending on the design of the filter circuit. The maximum amplitude will, of course, vary and may possibly go to zero for short periods. The signal 3A is coupled to the comparators 12, 14 which have differing threshold levels. The threshold for the comparator 12 may be at or near zero so that the comparator functions essentially as a zero crossing detector. Since there will normally be sufficient extraneous signals at or near the tone frequency to trigger the comparator 12, the output (3B) of the comparator will be a fairly regular square wave at the tone frequency. In addition to serving as the reset signal for the latch 16, signal 3B serves as the clock input for the shift register 18.

Figure 3:
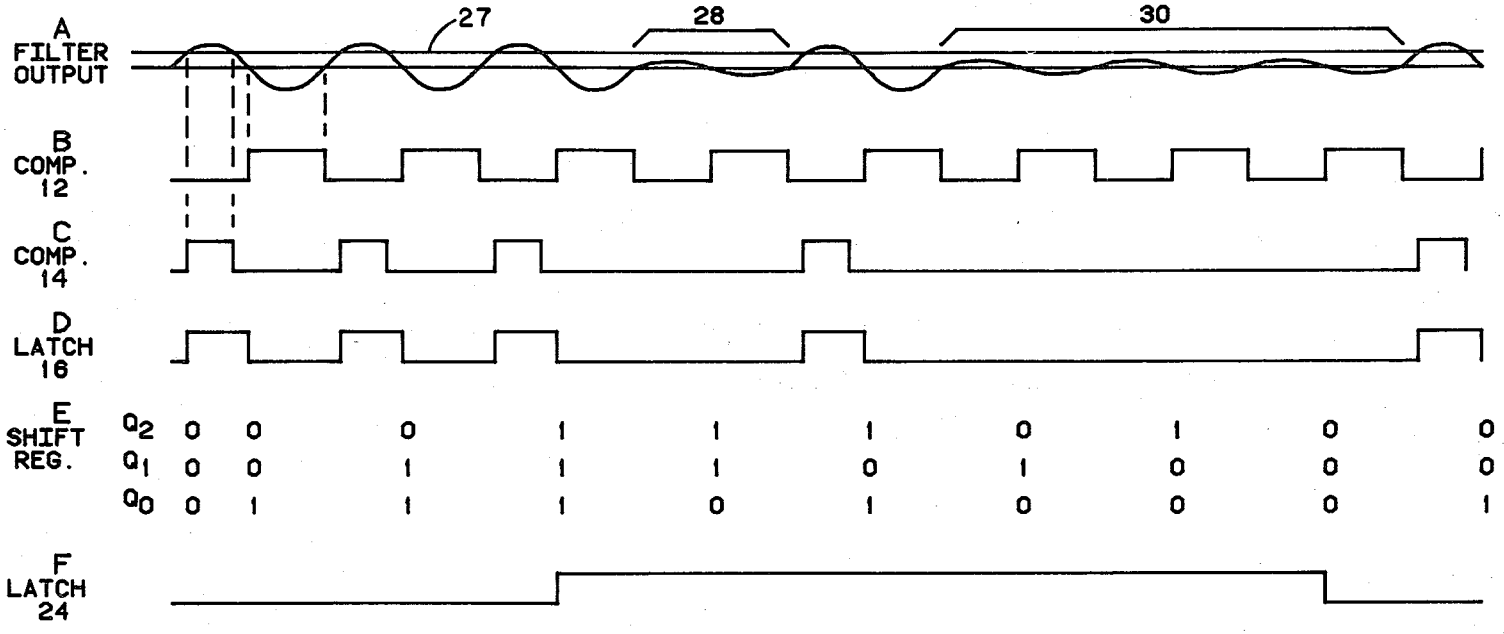
FIG. 3 is a timing diagram relating to the operation of the detector.

The threshold for the comparator 14 will preferably be set at some point near but lower than the minimum usable peak amplitude of the tone signal as indicated by the line 27 (FIG. 3). Thus, the output pulses (3C) of the comparator 14 will be narrower than the square pulses of 3B. the latch 16 is then set by the leading edge of 3C and reset by the leading edge of 3B.

The latch 16 output 3D is coupled to the "data" input of the shift register 18. Line 3E shows only three parallel outputs of the register 18 for drawing simplicity, but it is likely that more outputs; e.g., five or six, would be used for practical embodiments. At the first detection of a signal having the proper frequency and amplitude, a "1" would be coupled from the latch 16 to the shift register and, when clocked in, a "1" would appear at the $Q_0$ output of the register for an output of 0-0-1. At the second and third consecutive detects, the register outputs would be 0-1-1and 1-1-1 respectively. At the third detect, all inputs to the AND gate 20 are 1's, thus a 1 is coupled to the set input of the latch 24 and the latch output at the terminal 26 becomes a 1 as seen in 3F.

If, after latch 24 has been latched, one cycle of the tone signal is missing or of too low a value (as in period 28), one pulse of 3C will be missing and the register 18 outputs will become 1-1-0, but the latch 24 will stay latched. If, however, three pulses of 3C are missing or too low, as in the period 30, the shift register outputs will become 0-0-0. Since the shift register outputs are also the NOR gate 22 inputs, the NOR gate will now output a 1, resetting the latch 24 and causing the latch output to go to 0. The latch 24 output 3F will then stay at 0 until three consecutive cycles have been detected in the filter output signal 3A. It is to be noted that the AND gate 20 and NOR gate 22 need not have the same number of inputs, in other words, the number of consecutive cycles required to set the latch 24 need not necessarily be the same number of missing cycles required to reset the latch 24. It will be seen that, with the exception of the filter circuit 10, there are no capacitors in the device, thus it is very easy to implement as an integrated circuit or as part of a larger IC.

As is known, many present day receiver designs include some form of "scanner" or "seek" tuner whose function is to scan across the desired band, stopping when a suitable signal is detected. If it is desired to stop only for certain signals, such as stereophonic signals, the circuit of FIGS. 1 and 2 can provide that function by utilizing the signal at terminal 26. If, however, it is desired to scan the band more rapidly than the multiple detect would allow, it is also possible to use the signal at $Q_0$ of the register 18, or more than one register output, to provide a shorter delay or faster scan. In other words, if the signal at $Q_0$ or at $Q_0$ and $Q_1$ are 0's, the received signal is almost certainly not the desired signal, but if the signal at $Q_0$ is a 1, the scanning circuits would recognize that the received signal could be the desired type of signal (e.g., stereophonic) and would stop scanning long enough to allow the stereo detect signal from the latch 24 to be obtained. If the latch 24 was not latched in an appropriate period of time, scanning would resume as usual.

Figure 4:
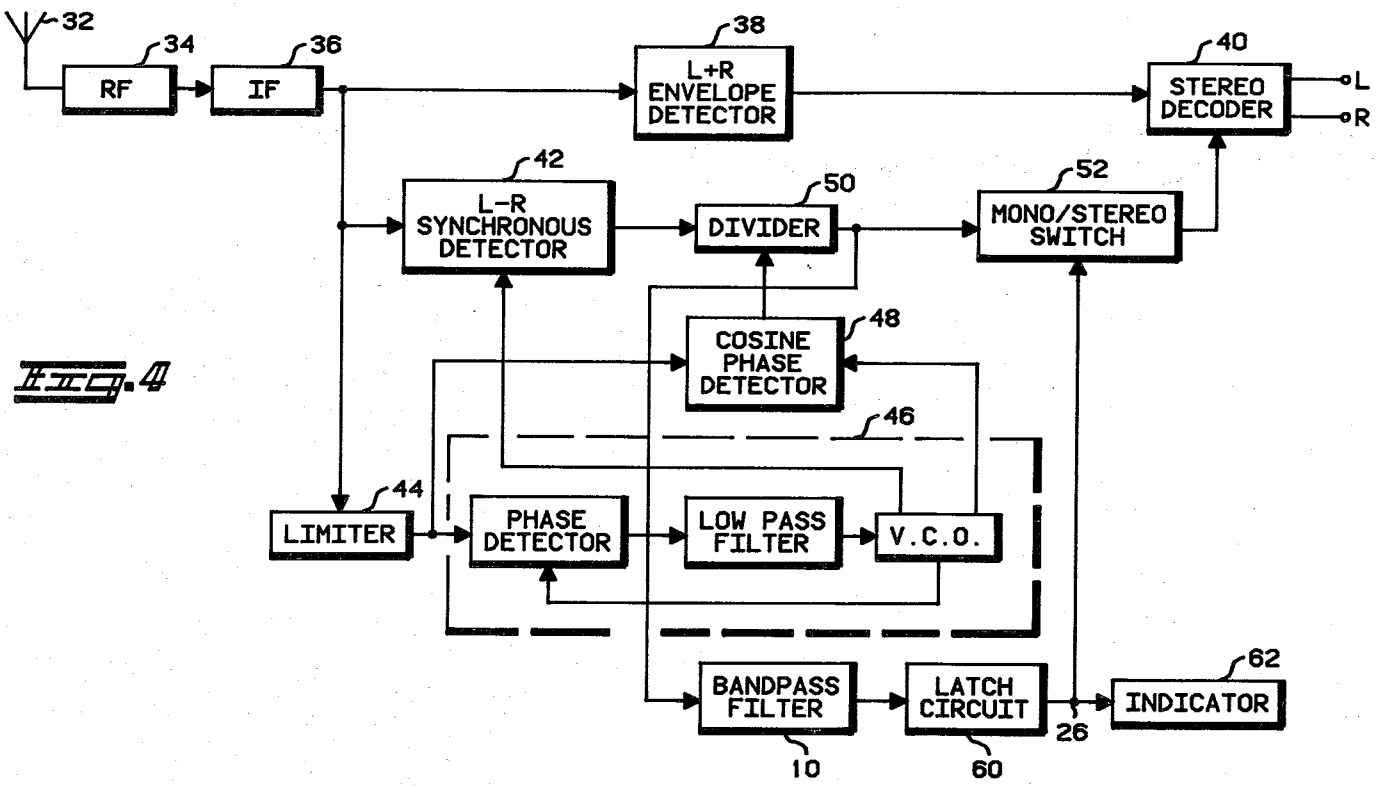
FIG. 4 is a block diagram illustrating one application of the invention.

In one suitable application of the invention, the tone to be detected is a low audio or near infrasonic frequency (20–25 Hz) which has been added to the difference (L−R) channel of an AM stereophonic transmission. The receiver shown in FIG. 4 is similar to the receiver of U.S. Pat. No. 4,192,968. That receiver was designed to receive an AM stereo signal of the form $(1+L+R)\cos\phi$ where $\phi$ is arc tan $[(L-R)/(1+L+R)]$. In the present receiver, provision has been made for also receiving a stereo signal wherein the signal in the difference channel also includes a stereo presence signal SP, thus $\phi$ is arc tan $[(L-R+SP)/(1+L+R)]$. The signal received at an antenna 32 is processed in normal fashion in an RF stage 34 and an IF stage 36, and the intermediate frequency signal is coupled to an envelope detector 38. The output (L+R) of the detector 38 is coupled to a stereo decoder 40 which may be a matrixing circuit. The IF signal is also coupled to a synchronous detector 42, the output of which will be essentially $(L-R+SP)\cos\phi$, and to a limiter 44 whose output will contain only the phase modulation of the received signal $(\cos\omega_c t+\phi)$. The limiter output is coupled to a phase locked loop 46 and to a cosine phase detector 48. The PLL 46 output $(\cos\omega_c t)$ is also coupled to the cosine phase detector 48, and the detector 48 output $(\cos\phi)$ is coupled to a divider 50 where it is divided into the synchronous detector output $(L-R+SP)\cos\phi$. The divider 50 output will then be (L−R+SP) and this signal may be coupled through a mono/stereo switching circuit 52 to the decoder 40 since the very low frequency of the stereo presence tone can be coupled through the audio stages up to and including the speakers if desired. Alternatively, the SP signal may be trapped or filtered out of the L−R channel if desired.

The divider output (L−R+SP) is also coupled to the bandpass filter 10 and the filtered output coupled to latch circuit 60, the latter circuit including comparators 12, 14, latches 16, 24, shift register 18 and gates 20, 22. The latch circuit output (3F) at the terminal 26 is coupled to an indicator 62 for a visual indication of the reception of a stereophonic signal, and is also coupled to control the mono/stereo mode switch 52. It is usually desirable to disconnect the difference signal from the matrix when no L−R information is being received. The switch 52 could be a simple voltage controlled switching transistor or a more complex circuit.

Thus, there has been shown and described a circuit for detecting one signal in a group of signals which may have varying amplitudes and frequencies. The circuit is latched when a predetermined number of consecutive cycles of the one signal have been detected, each cycle having a suitable amplitude, and the circuit is delatched only when a predetermined number of consecutive cycles have less than the suitable amplitude. In this circuit, the possibility of a false tone detect is essentially eliminated. Other modifications and variations of the circuit shown are possible and it is intended to cover all such as fall within the spirit and scope of the appended claims.

What is claimed is:

1. Tone detector means comprising:

input means for receiving signals which may include one signal of a predetermined frequency;

filter means coupled to the input means for outputting only those received signals at or near the predetermined frequency;

latching means coupled to the filter means and including comparator means for determining the peak amplitude of each detected cycle, shift register means coupled to the comparator means, and logic means coupled to the shift register means outputs for providing a first output signal only in response to the reception of a first predetermined number of consecutive cycles of said signal frequency, each said cycle having at least a predetermined peak amplitude, and a second output signal only in response to the reception of a second predetermined number of consecutive cycles of said signal frequency having an absolute value less than the predetermined peak amplitude; and means coupled to the latching means and responsive to the first and second output signals.

2. Tone detector means in accordance with claim 1 wherein the received signals are broadcast signals and the input means includes at least an RF stage, circuits coupled to the RF stage for providing a signal of an intermediate frequency in response to the RF stage output and demodulator means coupled to said circuits for detecting modulation on the intermediate frequency signals.

3. Tone detector means in accordance with claim 1 wherein the signal of a predetermined frequency is a very low audio frequency and the filter means is a low-pass filter.

4. Tone detector means in accordance with claim 1 wherein the filter means is a bandpass filter centered at the predetermined frequency.

5. Tone detector means in accordance with claim 1 and wherein the comparator means includes a first comparator having a first detect threshold and coupled to receive the output of the filter means, a second comparator having a second detect threshold, the second threshold being higher than the first threshold, and coupled to receive the output of the filter means, and wherein the latching means further includes first and second latches, the first latch being coupled to be set by the first comparator output and reset by the second comparator output and wherein the shift register is coupled to be clocked by the second comparator output and has a data input coupled to the first latch, and wherein the logic means includes first and second logic gates, the second latch being coupled to be set and reset by the respective logic gate outputs.

6. Tone detector means in accordance with claim 5 and wherein the first logic gate is an AND gate and provides an output in response to the first predetermined number of consecutive 1's at the outputs of the register means, and the second logic gate is a NOR gate and provides an output in response to the second predetermined number of consecutive 0's at the outputs of the register means.

7. Tone detector means in accordance with claim 1 wherein the responsive means coupled to the latching means includes a switching circuit.

8. Tone detector means in accordance with claim 1 wherein the responsive means coupled to the latching means includes an indicator.

9. A receiver for receiving a carrier wave which is modulated with signal information proportional to M+N where M is the amplitude of an intelligence signal and N is the amplitude of an indicator signal, the receiver comprising in combination:

means for selectively receiving the modulated carrier wave;

means for translating the received carrier wave to one of an intermediate frequency;

circuitry coupled to the translating means for providing an output signal substantially equal to M;

filter means coupled to the translating means for outputting only those signals at or near the frequency of said indicator signal;

latching means coupled to the filter means and including comparator means for determining the peak amplitude of each detected cycle, shift register means coupled to the comparator means, and logic means coupled to the shift register means outputs for providing a first output signal only in response to the reception of a first predetermined number of consecutive cycles of said indicator signal, each said cycle having at least a predetermined peak amplitude, and a second output signal only in response to the reception of a second predetermined number of consecutive cycles of said indicator signal having an absolute value of less than the predetermined peak amplitude; and switching means coupled to the latching means and activated in response to the first and second output signals thereof.

10. A receiver in accordance with claim 9 and wherein the indicator signal is a very low frequency signal and the filter means is a low-pass filter.

11. A receiver in accordance with claim 9 and wherein the filter means is a bandpass filter centered at the frequency of the indicator signal.

12. A receiver in accordance with claim 9 and wherein the comparator means includes a first comparator having a first detect threshold and coupled to receive the output of the filter means, a second comparator having a second detect threshold, the second threshold being higher than the first threshold, and coupled to receive the output of the filter means, and wherein the latching means further includes first and second latches, the first latch being coupled to be set by the first comparator output and reset by the second comparator output, and wherein the shift register means is coupled to be clocked by the second comparator output, and has a data input coupled to the first latch, and wherein the logic means includes first and second logic gates, the second latch being coupled to be set and reset by the respective logic gate outputs.

13. A receiver in accordance with claim 12 and wherein the first logic gate is an AND gate and provides an output in response to the first predetermined number of consecutive 1's at the outputs of the register means, and the second logic gate is a NOR gate and provides an output in response to the second predetermined number of consecutive 0's at the outputs of the register means.

14. A receiver for receiving a carrier wave which is amplitude modulated with signal information proportional to the sum of first (A) and second (B) intelligence signals and which is also modulated with signal information proportional to A−B+SP where SP is the amplitude of a stereo presence indicator signal, the receiver comprising in combination:

means for selectively receiving the modulated carrier wave;

means for translating the received carrier wave to one of an intermediate frequency;

decoding circuitry coupled to the translating means for providing output signals which are substantially equal to the first and second intelligence signals;

filter means coupled to the translating means for outputting only those signals at or very near the frequency of said stereo presence indicator signal;

latching means coupled to the filter means and including comparator means for determining the peak amplitude of each detected cycle, shift register means coupled to the comparator means, and logic means coupled to the shift register means outputs for providing a first output signal only in response to the reception of a first predetermined number of consecutive cycles of said signal frequency, each said cycle having at least a predetermined peak amplitude, and a second output signal only in response to the reception of a second predetermined number of consecutive cycles of said signal frequency having an absolute value less than the predetermined peak amplitude; and switching means coupled to the latching means output and to the decoding circuitry for enabling receiver operation in stereophonic and monophonic modes in response to the first and second latching means output signals respectively.

15. A receiver in accordance with claim 14 and further including indicator means coupled to the latching means output for providing first and second indications in response to the first and second output signals respectively.

16. A receiver for receiving a broadcast carrier wave which is amplitude modulated with signal information proportional to the sum of first (A) and second (B) intelligence signals and which is phase modulated by an angle $\phi$ having the form $\phi = \text{arc tan}$ $[C_1(A-B+SP)/(C_2+A+B)]$ where $C_1$ and $C_2$ are constants and SP is the amplitude of a stereo presence indicator signal, the receiver comprising in combination:

means for selectively receiving the modulated carrier wave;

means for translating the received carrier wave to one of an intermediate frequency;

decoding circuitry coupled to the translating means for providing output signals which are substantially equal to the first and second intelligence signals;

filter means coupled to the translating means for outputting those signals at or near the frequency of said stereo presence indicator signal;

latching means coupled to the filter means and including comparator means for determining the peak amplitude of each detected cycle, shift register means coupled to the comparator means, and logic means coupled to the shift register means outputs for providing a first output signal only in response to the reception of a first predetermined number of consecutive cycles of said signal frequency, each said cycle having at least a predetermined peak amplitude, and a second output signal only in response to the reception of a second predetermined number of consecutive cycles of said signal frequency having an absolute value less than the predetermined maximum peak amplitude; and switching means coupled to the latching means output and to the decoding circuitry for enabling receiver operation in stereophonic and monophonic modes in response to the first and second latching means output signals respectively.

* * * * *